US008523090B2

(12) United States Patent
Manubolu et al.

(10) Patent No.: US 8,523,090 B2
(45) Date of Patent: Sep. 3, 2013

(54) FUEL INJECTION SYSTEMS AND ARMATURE HOUSINGS

(75) Inventors: Avinash R. Manubolu, Edwards, IL (US); Stephen R. Lewis, Chillicothe, IL (US); Jayaraman K. Venkataraghavan, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 669 days.

(21) Appl. No.: 12/645,646

(22) Filed: Dec. 23, 2009

(65) Prior Publication Data

US 2011/0147495 A1 Jun. 23, 2011

(51) Int. Cl.
*F02M 51/00* (2006.01)

(52) U.S. Cl.
USPC ..... 239/585.5; 239/585.1; 239/585.4; 251/129.15

(58) Field of Classification Search
USPC 239/585.1, 585.3, 585.4, 585.5; 251/129.15, 251/129.16
See application file for complete search history.

(56) References Cited

U.S. PATENT DOCUMENTS

| | | | | |
|---|---|---|---|---|
| 4,231,525 | A | 11/1980 | Palma | |
| 4,540,122 | A | 9/1985 | Teerman | |
| 5,735,375 | A | 4/1998 | Booth et al. | |
| 5,937,887 | A * | 8/1999 | Baxter et al. | 239/585.3 |
| 6,056,264 | A * | 5/2000 | Benson et al. | 251/129.15 |
| 6,669,166 | B2 | 12/2003 | Enomoto et al. | |
| 6,749,137 | B2 | 6/2004 | Kato et al. | |
| 6,752,374 | B2 | 6/2004 | Miyamoto et al. | |
| 2003/0010848 | A1 * | 1/2003 | Laumen | 239/585.1 |

FOREIGN PATENT DOCUMENTS

| | | |
|---|---|---|
| WO | 00/28206 | 5/2000 |

* cited by examiner

*Primary Examiner* — Steven J Ganey
(74) *Attorney, Agent, or Firm* — Miller, Matthias & Hull

(57) ABSTRACT

A housing for an armature of a fuel injector, a fuel injector and a fuel injection system are disclosed. The armature housing includes a first cylindrical portion for slidably accommodating the armature pin. The first cylindrical portion has a minimum inner diameter that is closely matched to the maximum outer diameter of the armature pin. A second cylindrical portion of the armature housing accommodates the armature. The second cylindrical portion has an inner minimum diameter that is closely matched to the maximum outer diameter of the armature. The disclosed armature housing provides more reliable and more consistent movement of the armature.

28 Claims, 4 Drawing Sheets

FIG. 2
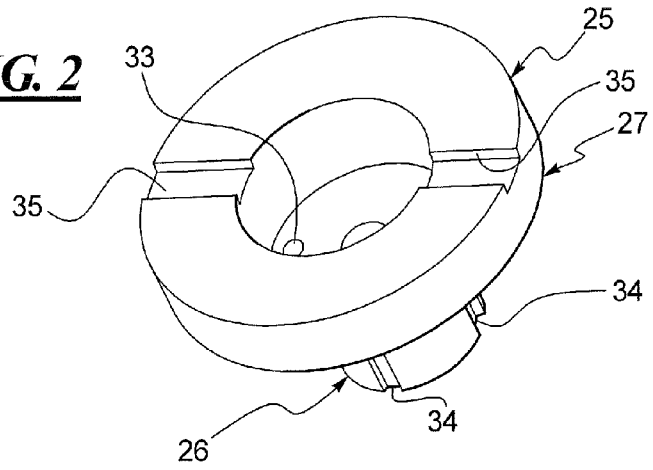
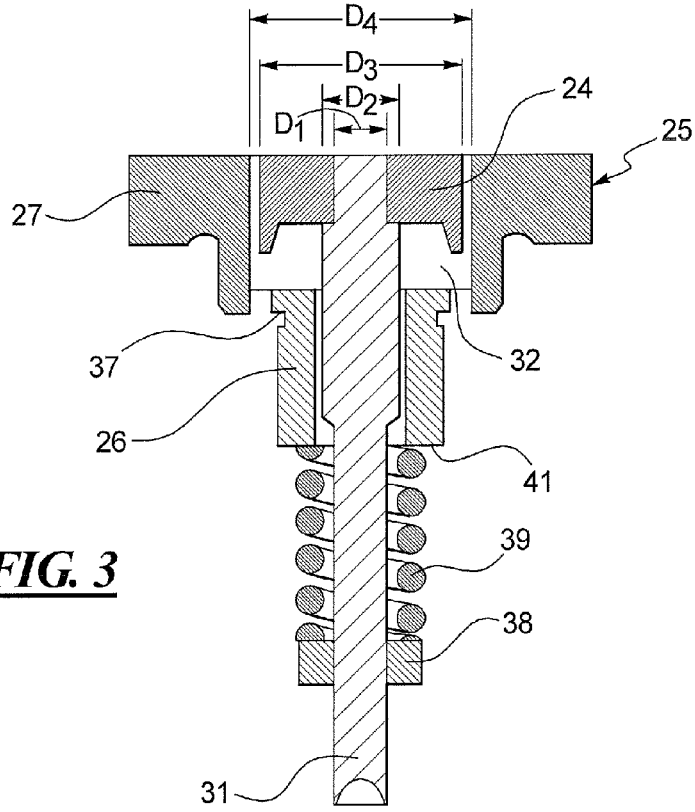
FIG. 3

FUEL INJECTION SYSTEMS AND ARMATURE HOUSINGS

TECHNICAL FIELD

This disclosure relates generally to fuel injection systems and improved armatures and armature housings for electrically operated fuel injectors.

BACKGROUND

Fuel injected engines employ fuel injectors, each of which delivers a metered quantity of fuel to an associated engine cylinder during each engine cycle. Prior fuel injectors were of the mechanically or hydraulically actuated type with either mechanical or hydraulic control of fuel delivery. More recently, electronically controlled fuel injectors have been developed. In the case of an electronic injector, fuel is supplied to the injector by a transfer pump. The injector may include various mechanisms for pressurizing the fuel delivered by the transfer pump. An electrically operated mechanism either carried outside the injector body or disposed within the injector body is then actuated to cause fuel delivery to the associated engine cylinder.

Prior fuel injector designs have included high pressure fuel passages extending around a central recess containing a solenoid coil and a solenoid armature. One such fuel injection system that delivers pressurized fuel from a high pressure pump and through a common rail to fuel injectors with solenoid valves is illustrated in U.S. Pat. No. 5,975,437. In such systems, the high pressure fuel passage includes turns and bends in order not to intersect the solenoid recess, thereby complicating formation of the passages and requiring the use of plugs to seal off portions of the passages after formation.

Because the overall size of the fuel injector is small, the size of the solenoid is also small, thereby undesirably reducing the available solenoid force on the armature. As a result, the armature should be placed accurately with respect to the solenoid to provide the reliable movement of the armature during the opening and closing the high pressure fuel injector valve.

SUMMARY OF THE DISCLOSURE

One aspect of this disclosure involves an improved armature housing and armature for a fuel injector that provides for a more reliable and consistent movement of the armature when its corresponding solenoid coil is activated. The disclosed armature is coupled to an armature pin. The armature housing includes a first cylindrical portion that slidably accommodates the armature pin. The armature housing also includes a second cylindrical portion that is coupled to the first cylindrical portion. The second cylindrical portion slidably accommodates the armature. Using appropriate manufacturing tolerances for the outer diameters of the armature pin and armature and the inner diameters of the first and second cylindrical portions respectively, the disclosed armature housing provides for more reliable and consistent movement of the armature when the solenoid is energized.

In another aspect of this disclosure, a fuel injector is disclosed that includes an armature coupled to an armature pin. The fuel injector also includes an armature housing that includes a first cylindrical portion for slidably accommodating the armature pin and a second cylindrical portion coupled to the first cylindrical portion. The second cylindrical portion slidably accommodates the armature. The fuel injector also includes a solenoid including a stator and a coil that engages the second cylindrical portion of the armature housing. The armature pin includes a distal end that includes or is coupled to a closure element. The closure element engages a first orifice of an orifice plate when the armature is in a relaxed position. The closure element is lifted off of the first orifice and the orifice plate when the solenoid is energized and the armature pin and closure element are moved away from the orifice plate.

In another aspect of this disclosure, a fuel injection system is provided. The disclosed fuel injection system includes a common rail containing high pressure fuel. The fuel injection system also includes a plurality of fuel injectors fluidly connected to the common rail. Each of the fuel injectors includes an armature coupled to an armature pin. Each fuel injector also includes an armature housing including a first cylindrical portion for slidably accommodating the armature pin and a second cylindrical portion coupled to the first cylindrical portion for slidably accommodating the armature. Each fuel injector of the system also includes a solenoid including a stator and a coil that engages the second cylindrical portion of the armature housing. The armature pin of each injector has a distal end that includes or is coupled to a closure element. The closure element engages a first orifice of an orifice plate when the armature is in a relaxed position. The closure element is lifted off of the first orifice and orifice plate when the solenoid is energized and the armature, armature pin and closure element are moved away from the orifice plate.

BRIEF DESCRIPTION OF THE DRAWINGS

FIG. 2 is a perspective view of a disclosed armature housing.

FIG. 3 is a sectional view of the armature housing, armature, armature pin and armature spring as shown in FIG. 1.

DETAILED DESCRIPTION

Figure 1:
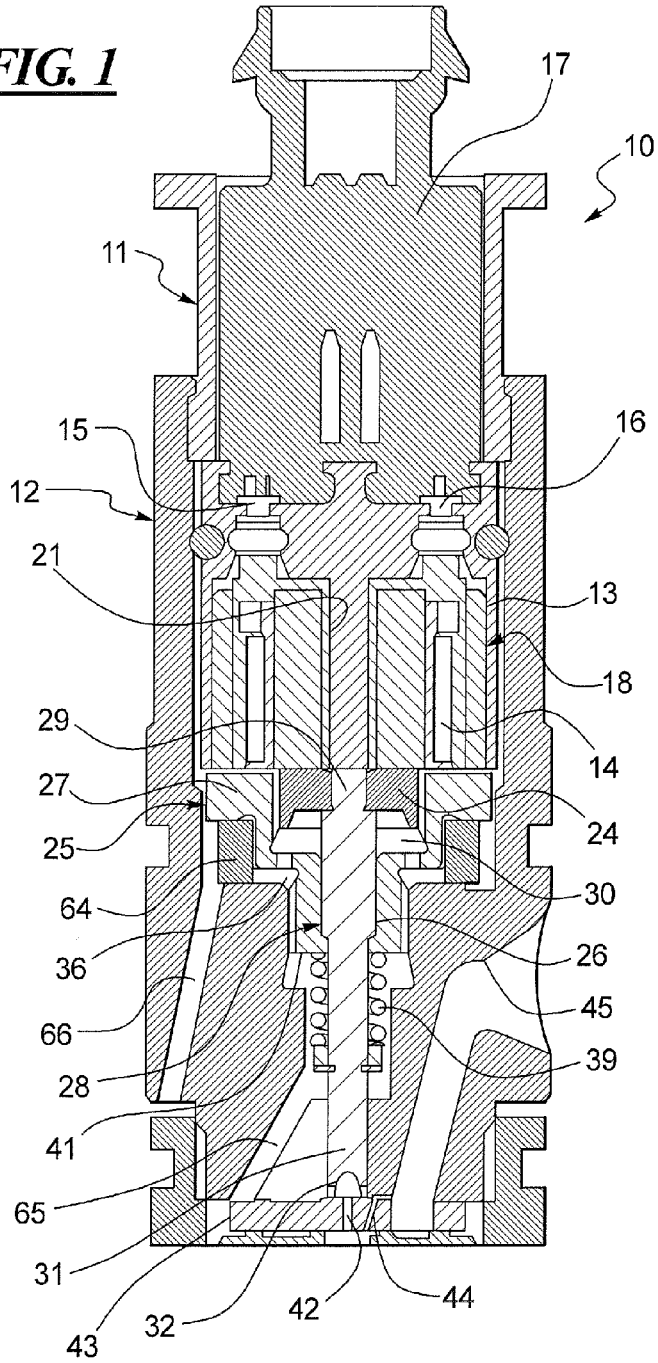
FIG. 1 is a partial sectional view of a disclosed fuel injector illustrating a disclosed armature housing, armature, armature pin, solenoid assembly and injector body.

Turning first to FIG. 1, a partial view of a disclosed fuel injector 10 is illustrated. The fuel injector 10 includes a solenoid case 11 which is coupled to an injector body 12. The solenoid case 11 houses the solenoid assembly 18 which includes a stator 13, coil or magnet 14, guideposts 15, 16 and an upper cap 17. The stator 13 may also include a central aperture 21 which accommodates a guide pin 22 to facilitate the upward movement of the stator 13 and coils 14 when the solenoid assembly 18 is energized causing the armature 24 to push against the stator 13 and causing the stator 13 and coil 14 to move towards the upper cap 17 to an energized or open position. The armature 24 is accommodated within an armature housing 25.

As shown in FIGS. 2-3, the armature housing 25 includes a first cylindrical portion 26 and a second cylindrical portion 27. The first cylindrical portion 26 slidably accommodates the armature pin 28 which includes a proximal end 29 that is connected to the armature 24 and a distal end 31 that may include or be coupled to a closure element 32 as shown in FIG. 1. The first cylindrical portion 26 may be coupled to the second cylindrical portion 27 by an annular disk 30. The annular disk 30 may include one or more drain openings 33 as best seen in FIG. 2. The second cylindrical portion 27 slidably accommodates the armature 24. The second cylindrical portion 27 is non-carburized and the first cylindrical portion 26 is carburized to maximize the magnetic flux across the armature 24 when the coil 14 is energized.

Turning back to FIG. 1, the armature housing 25 may be held in place in the injector body 12 by a snap ring 36 received in the circumferential slot 37 in the first cylindrical portion 26 as shown in FIG. 3. Other means for securing the armature housing 25 to the injector body 12 are available as will be apparent to those skilled in the art. For example, the second cylindrical portion 27 could be secured to the injector body 12. Thus, the armature housing 25 is stationary within the injector body 12; the armature 24 and armature pin 28 move under the influence of the solenoid assembly 18.

Figure 4:
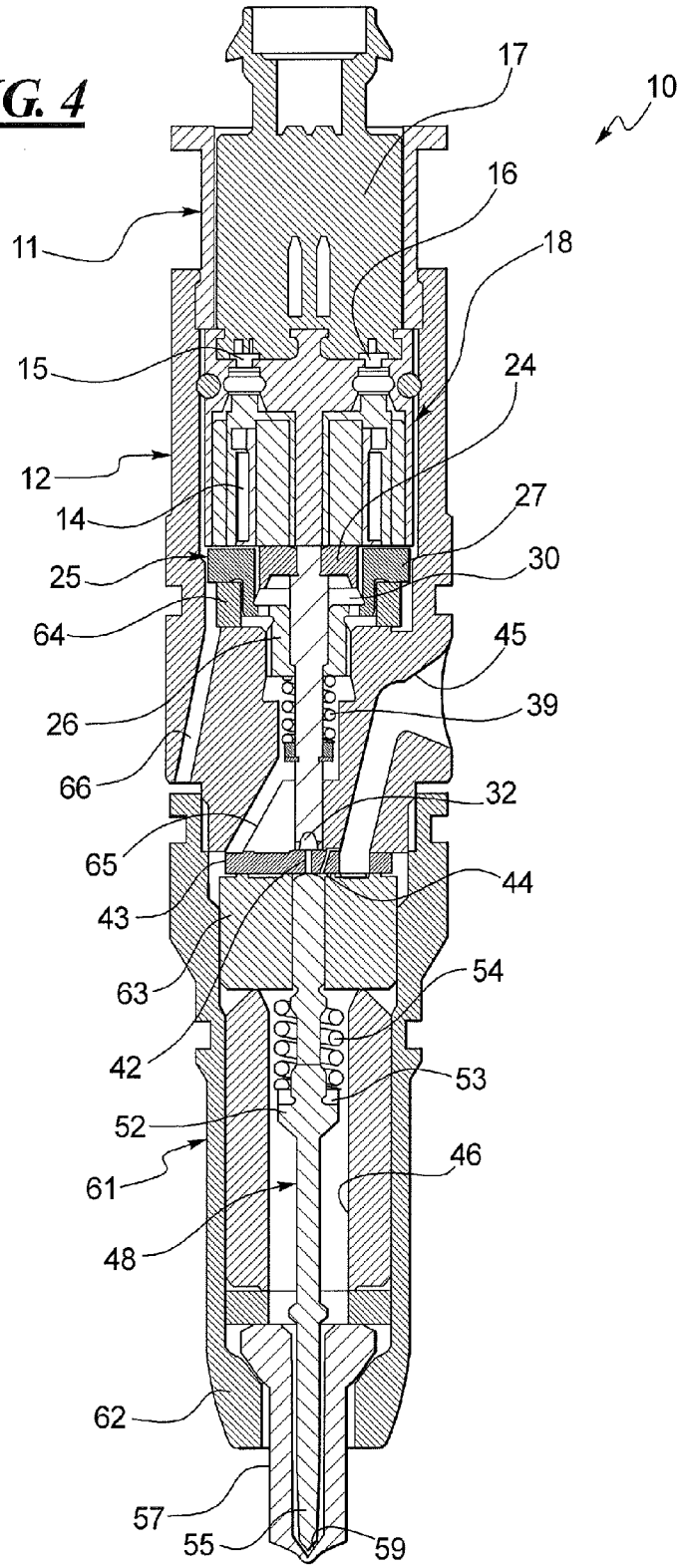
FIG. 4 is a sectional view of a disclosed fuel injector.

Specifically, the armature pin 28 is connected to a collar 38 that traps the armature spring 39 between the collar 38 and the lower surface 41 of the first cylindrical portion 26. The armature spring 39 acts to pull the armature pin 28 and armature 24 away from the solenoid assembly 18 or downward in the perspective of FIG. 1 so the closure element 32 closes the orifice 42 in the orifice plate 43 as shown in FIGS. 1 and 4. Thus, the armature spring 39 biases the armature 24 and armature pin 28 downward in the relaxed or closed position shown in FIGS. 1 and 4.

Figure 5:
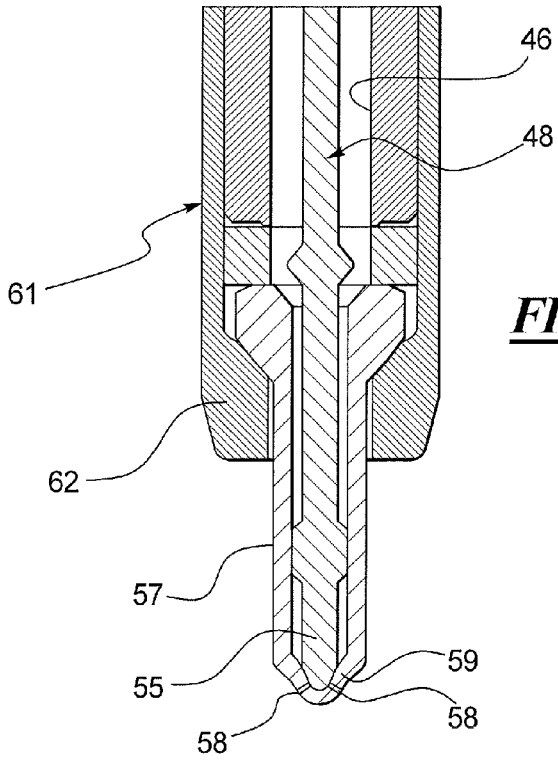
FIG. 5 is an enlarged view of the nozzle, needle valve and distal end of the valve casing.

FIGS. 1 and 4 also illustrate a fuel passageway 45. The fuel passageway 45 contains high pressure fuel which is delivered below the orifice plate 43 and into the valve chamber 46 (see FIG. 4). The high pressure fuel is provided by the common rail 47 shown in FIG. 6. With the closure element 32 blocking the orifice 42 of the orifice plate 43, high pressure fuel entering the chamber 46 establishes an equilibrium pressure in the chamber 46 and may circulate through the unblocked slanted orifice 44. In this high-pressure equilibrium condition, the bias of the spring 54 maintains the distal nose 55 of the needle valve 48 against the seat 59 of the nozzle 57 and in the closed position shown in FIGS. 4 and 5.

The needle valve 48 includes a proximal end 51 disposed opposite the orifice 42 from the closure element 32. The needle valve 48 may also include a collar or shoulder 52 to support an end or collar 53 of the valve spring 54. In the position shown in FIGS. 4-5, the needle valve 48 is biased downward by the spring 54 so that the distal nose 55 rests on the seat 59 and blocks fluid from exiting the nozzle 57 through the orifice 58 that are more easily seen in FIG. 5.

When the solenoid coil 14 is activated and the armature 24 and armature pin 28 move towards the stator 13 or upward in the orientation of FIG. 4, the closure element 32 moves away from the orifice 42 thereby creating a pressure drop from the chamber 46 to the orifice plate 43. This pressure drop enables the fuel pressure in the chamber 46 to overcome the bias of the spring 54 and move the distal nose 55 of the needle valve 48 off of the seat 59 thereby permitting fuel to exit the nozzle 57 through the orifice 58.

In the embodiment shown, the solenoid case 11 is connected to injector body 12 which, in turn, is connected to the valve body 61. The distal end 62 of the valve body 61 is coupled to the nozzle 57. The orifice plate 43 may be sandwiched between the fuel injector body 12 and a block 63. The fuel passageway 45 may pass through the block 63 as well as the orifice plate 43. The second cylindrical portion 27 of the armature housing 25 is supported by a spacer shown at 64 in FIGS. 1 and 4. Drain passages for fuel that is used as coolant as it circulates through the slanted orifice 44 are shown at 65, 66. Thus, not only is the slanted orifice 44 of the orifice plate 43 used to establish a pressure equilibrium in the valve chamber 46 when the valve 48 is in a closed position, the high-pressure fuel that passes through the orifice 44 also spreads to other components of the fuel injector 10 and serves as a coolant medium.

Figure 6:
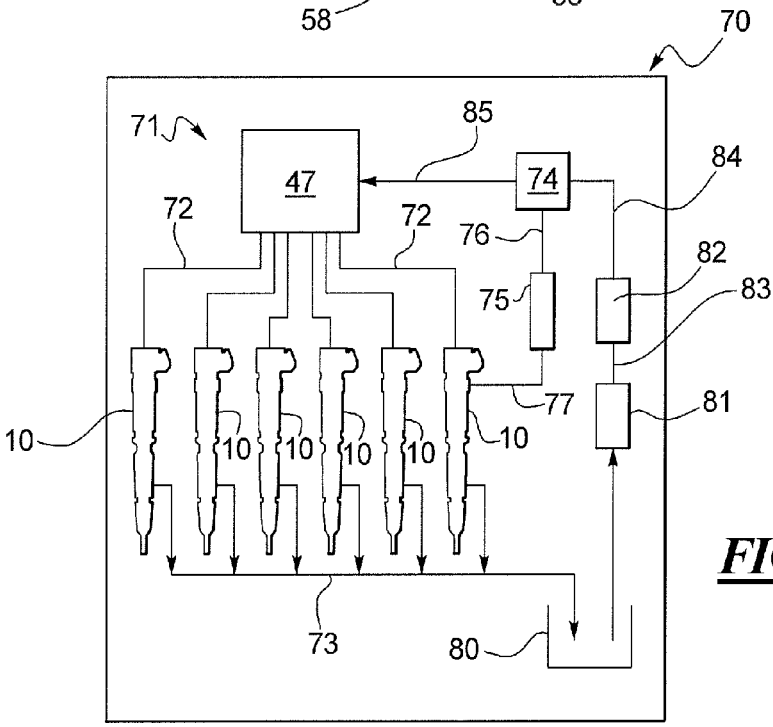
FIG. 6 is a schematic view of a disclosed fuel injection system.

Turning to FIG. 6, an engine 70 is disclosed that includes a fuel injection system 71. The fuel injection system 71 includes the high pressure common rail 47 that is linked by passages 72 to the plurality of fuel injectors 10 described above in connection with FIGS. 1-5. A common drain passage is shown at 73. A high pressure pump 74 delivers fuel to the common rail 47. The pump 74 and fuel injectors 10 may be controlled by electronic control module (ECM) 75 via the communication lines 76, 77. A fuel tank is shown at 80 which receives fuel from the drain line 73 and provides fuel to the filter 81 by the preliminary pump 82 which is in communication with the high pressure pump 74 via the supply passages 83, 84. The high-pressure pump 74 is connected to the common rail 47 by the supply passage 85.

Industrial Applicability

Improvements to fuel injectors and fuel injection systems are disclosed that are based on the disclosed armature housing 25. The disclosed armature housing 25 includes a first cylindrical portion 26 that is designed with tight tolerances with respect to the armature pin 28. The armature housing 25 also includes a second cylindrical portion 27 that is also designed with tight tolerances with respect to the armature 24. The tolerances used for the armature pin 28/first cylindrical portion 26 will typically be less than the tolerances used for the armature 24/second cylindrical portion 27.

More specifically, as shown in FIG. 3, the first cylindrical portion 26 has a inner minimum diameter D2 that is 2-7 microns greater than the maximum outer diameter D1 of the armature pin 28, thereby providing a close, but free sliding fit between the armature pin 28 and the cylindrical portion 26. Further, unwanted lateral movement of the armature 24 within the armature housing 25 is prevented by providing the cylindrical portion 27 with an inner minimum diameter D4 that is 10-30 microns greater than the maximum outer diameter D3 of the armature 24. The difference between in minimum inner diameter D2 of the first cylindrical portion 26 and the maximum outer diameter D1 of the armature pin 28 will typically be less than the difference between the minimum inner diameter D4 of the second cylindrical portion 27 and the maximum outer diameter D3 of the armature 24.

In one example, the tolerance used for the armature pin 28/first cylindrical portion 26 may be about 4 microns and the tolerance used for the armature 24/second cylindrical portion 27 may be about 10 microns, but the tolerances can vary, depending on the size of the fuel injector 10 and the materials used for the first and second cylindrical portions 26, 27 of the armature housing 25, the armature 24 and the armature pin 28.

Thus, the disclosed armature housing 25 provides a more reliable movement of the armature 24 and armature pin 28 when the solenoid assembly 18 is activated. By providing a more reliable movement of the armature 24 and armature pin 28, the disclosed armature housing 25 provides a more reliable release of the closure element 32 from the orifice 42 and therefore a more reliable opening of the valve 48. Conversely, by providing a more reliable movement of the armature 24 and armature pin 28, the disclosed armature housing 25 provides a more reliable engagement of the closure element 32 on the orifice 42 and therefore a more reliable closing of the valve 48.

What is claimed is:

1. A combination armature and armature housing, the combination comprising:

an armature coupled to an armature pin, the armature having a maximum outer diameter, the armature pin having and maximum outer diameter;

an armature housing including a first cylindrical portion for slidably accommodating the armature pin, the first cylindrical portion having an inner minimum diameter that is greater than the maximum outer diameter of the armature pin;

the armature housing further including a second cylindrical portion coupled to the first cylindrical portion, the second cylindrical portion for slidably accommodating the armature, the second cylindrical portion having an inner minimum diameter that is greater than the maximum outer diameter of the armature;

wherein the first cylindrical portion is coupled to the second cylindrical portion by an annular disk disposed between the armature and the first cylindrical portion.

2. The combination of claim 1 wherein the inner minimum diameter of the first cylindrical portion is greater than the outer maximum diameter of the armature pin by an amount ranging from about 2 to about 7 μm.

3. The combination of claim 1 wherein the inner minimum diameter of the second cylindrical portion is greater than the outer maximum diameter of the armature by an amount ranging from about 10 to about 30 μm.

4. The combination of claim 1 wherein a difference between the inner minimum diameter of the first cylindrical portion and the outer maximum diameter of the armature pin is less than a difference between the inner minimum diameter of the second cylindrical portion and the outer maximum diameter of the armature.

5. The combination of claim 1 wherein the first cylindrical portion is carburized.

6. The combination of claim 1 wherein the second cylindrical portion is non-carburized.

7. The combination of claim 1 wherein the annular disk including at least one through hole for the passage of fluid.

8. The combination of claim 1 wherein the first cylindrical portion includes at least one circumferential slot for engaging a snap ring to hold the first cylindrical portion in a fixed position.

9. The combination of claim 1 wherein the second cylindrical portion includes an annular surface disposed opposite the second cylindrical portion from the first cylindrical portion, the annular surface including at least one slot for the passage of fluid.

10. The combination of claim 1 wherein the first cylindrical portion includes an outer surface that includes at least one longitudinal slot for the passage of fluid.

11. A fuel injector comprising:

an armature coupled to an armature pin, the armature having a maximum outer diameter, the armature pin having and maximum outer diameter;

an armature housing including a first cylindrical portion for slidably accommodating the armature pin, the first cylindrical portion having an inner minimum diameter greater than the maximum outer diameter of the armature pin, the armature housing also including a second cylindrical portion coupled to the first cylindrical portion, the second cylindrical portion for slidably accommodating the armature, the second cylindrical portion having an inner minimum diameter greater than the maximum outer diameter of the armature;

a solenoid including a coil and a stator disposed outside of the armature housing and opposite the second cylindrical portion from the first cylindrical portion of the armature housing;

the armature pin having a distal end that is coupled to a closure element, the closure element engaging a first orifice of a orifice plate when the armature is in a relaxed position, the closure element being lifted off of the first orifice and orifice plate when the solenoid is energized and the armature, armature pin and closure element are moved away from the orifice plate.

12. The fuel injector of claim 11 wherein the inner minimum diameter of the first cylindrical portion is greater than the outer maximum diameter of the armature pin by an amount ranging from about 2 to about 7 μm.

13. The fuel injector of claim 11 wherein the inner minimum diameter of the second cylindrical portion is greater than the outer maximum diameter of the armature by an amount ranging from about 10 to about 30 μm.

14. The fuel injector of claim 11 wherein a difference between the inner minimum diameter of the first cylindrical portion and the outer maximum diameter of the armature pin is less than a difference between the inner minimum diameter of the second cylindrical portion and the outer maximum diameter of the armature.

15. The fuel injector of claim 11 wherein the first cylindrical portion is carburized and the second cylindrical portion is non-carburized.

16. The fuel injector of claim 11 wherein the first cylindrical portion is coupled to the second cylindrical portion by an annular disk disposed between the armature and the first cylindrical portion, the annular disk including at least one through hole for the passage of fluid.

17. The fuel injector of claim 11 wherein the armature housing and armature are supported within an injector body, the first cylindrical portion includes at least one circumferential slot for engaging a snap ring that secures the first cylindrical member to the injector body, the second cylindrical portion includes an annular surface disposed opposite the second cylindrical portion from the first cylindrical portion, the annular surface including at least one slot for the passage of fluid to one or more drains disposed in the injector body, the first cylindrical portion includes outer surface that includes at least one longitudinal slot for the passage of fluid to the one or more drains disposed in the injector body.

18. The fuel injector of claim 11 further including an injector body that accommodates the armature housing, armature and armature pin, the injector body including a fuel passageway extends past the orifice plate to a valve chamber, the valve chamber accommodating a valve, the valve being in a closed position when the closure element engages the first orifice, the valve being in an open position when the closure element is moved away from the first orifice when the solenoid is energized, the orifice plate includes a second orifice for establishing an equilibrium pressure in the valve chamber when the valve chamber is closed.

19. A fuel injection system comprising:

a common rail containing high pressure fuel;

a plurality of fuel injectors fluidly connected to the common rail;

each of the fuel injectors including an armature coupled to armature pin, the armature having a maximum outer diameter, the armature pin having and maximum outer diameter;

an armature housing including a first cylindrical portion for slidably accommodating the armature pin, the first cylindrical portion having an inner minimum diameter that is greater than of the maximum outer diameter of the armature pin, the armature housing also including a second cylindrical portion coupled to the first cylindrical portion, the second cylindrical portion for slidably accommodating the armature, the second cylindrical portion having an inner minimum diameter that is greater than the maximum outer diameter of the armature;

a solenoid including a stator and a coil that engages on second cylindrical portion of the armature housing;

the armature pin having a distal end that is coupled to a closure element, the closure element engaging a first orifice of a orifice plate when the armature is in a relaxed position, the closure element being lifted off of the first orifice and orifice plate when solenoid is energized and the armature, armature pin and closure element are moved away from the orifice plate;

wherein the first cylindrical portion is coupled to the second cylindrical portion by an annular disk disposed between the armature and the first cylindrical portion, the annular disk including at least one through hole for the passage of fluid.

20. The fuel injection system of claim 19 wherein the inner minimum diameter of the first cylindrical portion is greater than the outer maximum diameter of the armature pin by an amount ranging from about 2 to about 7 μm, and wherein the inner minimum diameter of the second cylindrical portion is greater than the outer maximum diameter of the armature by an amount ranging from about 10 to about 30 μm.

21. A combination armature and armature housing, the combination comprising:

an armature coupled to an armature pin, the armature having a maximum outer diameter, the armature pin having and maximum outer diameter;

an armature housing including a first carburized cylindrical portion for slidably accommodating the armature pin, the first cylindrical portion having an inner minimum diameter that is greater than the maximum outer diameter of the armature pin;

the armature housing further including a second cylindrical portion coupled to the first cylindrical portion, the second cylindrical portion for slidably accommodating the armature, the second cylindrical portion having an inner minimum diameter that is greater than the maximum outer diameter of the armature.

22. A combination armature and armature housing, the combination comprising:

an armature coupled to an armature pin, the armature having a maximum outer diameter, the armature pin having and maximum outer diameter;

an armature housing including a first cylindrical portion for slidably accommodating the armature pin, the first cylindrical portion having an inner minimum diameter that is greater than the maximum outer diameter of the armature pin;

the armature housing further including a second cylindrical portion that is non-carburized and that is coupled to the first cylindrical portion, the second cylindrical portion for slidably accommodating the armature, the second cylindrical portion having an inner minimum diameter that is greater than the maximum outer diameter of the armature.

23. A combination armature and armature housing, the combination comprising:

an armature coupled to an armature pin, the armature having a maximum outer diameter, the armature pin having and maximum outer diameter;

an armature housing including a first cylindrical portion for slidably accommodating the armature pin, the first cylindrical portion having an inner minimum diameter that is greater than the maximum outer diameter of the armature pin;

the armature housing further including a second cylindrical portion coupled to the first cylindrical portion, the second cylindrical portion for slidably accommodating the armature, the second cylindrical portion having an inner minimum diameter that is greater than the maximum outer diameter of the armature, the first cylindrical portion being coupled to the second cylindrical portion by an annular disk disposed between the armature and the first cylindrical portion, the annular disk including at least one through hole for the passage of fluid.

24. A combination armature and armature housing, the combination comprising:

an armature coupled to an armature pin, the armature having a maximum outer diameter, the armature pin having and maximum outer diameter;

an armature housing including a first cylindrical portion for slidably accommodating the armature pin, the first cylindrical portion having an inner minimum diameter that is greater than the maximum outer diameter of the armature pin;

the armature housing further including a second cylindrical portion coupled to the first cylindrical portion, the second cylindrical portion for slidably accommodating the armature, the second cylindrical portion having an inner minimum diameter that is greater than the maximum outer diameter of the armature;

the first cylindrical portion includes at least one circumferential slot for engaging a snap ring to hold the first cylindrical portion in a fixed position.

25. A fuel injector comprising:

an armature coupled to an armature pin, the armature having a maximum outer diameter, the armature pin having and maximum outer diameter;

an armature housing including a carburized first cylindrical portion for slidably accommodating the armature pin, the first cylindrical portion having an inner minimum diameter greater than the maximum outer diameter of the armature pin, the armature housing also including a non-carburized second cylindrical portion coupled to the first cylindrical portion, the second cylindrical portion for slidably accommodating the armature, the second cylindrical portion having an inner minimum diameter greater than the maximum outer diameter of the armature;

a solenoid including a coil and a stator that engages the second cylindrical portion of the armature housing;

the armature pin having a distal end that is coupled to a closure element, the closure element engaging a first orifice of a orifice plate when the armature is in a relaxed position, the closure element being lifted off of the first orifice and orifice plate when the solenoid is energized and the armature, armature pin and closure element are moved away from the orifice plate.

26. A fuel injector comprising:

an armature coupled to an armature pin, the armature having a maximum outer diameter, the armature pin having and maximum outer diameter;

an armature housing including a first cylindrical portion for slidably accommodating the armature pin, the first cylindrical portion having an inner minimum diameter greater than the maximum outer diameter of the armature pin, the armature housing also including a second cylindrical portion coupled to the first cylindrical portion, the second cylindrical portion for slidably accommodating the armature, the second cylindrical portion having an inner minimum diameter greater than the maximum outer diameter of the armature;

a solenoid including a coil and a stator that engages the second cylindrical portion of the armature housing;

the armature pin having a distal end that is coupled to a closure element, the closure element engaging a first orifice of a orifice plate when the armature is in a relaxed position, the closure element being lifted off of the first orifice and orifice plate when the solenoid is energized and the armature, armature pin and closure element are moved away from the orifice plate;

wherein the first cylindrical portion is coupled to the second cylindrical portion by an annular disk disposed between the armature and the first cylindrical portion, the annular disk including at least one through hole for the passage of fluid.

27. A fuel injector comprising:

an armature coupled to an armature pin, the armature having a maximum outer diameter, the armature pin having and maximum outer diameter;

an armature housing including a first cylindrical portion for slidably accommodating the armature pin, the first cylindrical portion having an inner minimum diameter greater than the maximum outer diameter of the armature pin, the armature housing also including a second cylindrical portion coupled to the first cylindrical portion, the second cylindrical portion for slidably accommodating the armature, the second cylindrical portion having an inner minimum diameter greater than the maximum outer diameter of the armature;

a solenoid including a coil and a stator that engages the second cylindrical portion of the armature housing;

the armature pin having a distal end that is coupled to a closure element, the closure element engaging a first orifice of a orifice plate when the armature is in a relaxed position, the closure element being lifted off of the first orifice and orifice plate when the solenoid is energized and the armature, armature pin and closure element are moved away from the orifice plate;

wherein the armature housing and armature are supported within an injector body, the first cylindrical portion includes at least one circumferential slot for engaging a snap ring that secures the first cylindrical member to the injector body;

the second cylindrical portion includes an annular surface disposed opposite the second cylindrical portion from the first cylindrical portion, the annular surface including at least one slot for the passage of fluid to one or more drains disposed in the injector body, the first cylindrical portion includes outer surface that includes at least one longitudinal slot for the passage of fluid to the one or more drains disposed in the injector body.

28. A fuel injector comprising:

an armature coupled to an armature pin, the armature having a maximum outer diameter, the armature pin having and maximum outer diameter;

an armature housing including a first cylindrical portion for slidably accommodating the armature pin, the first cylindrical portion having an inner minimum diameter greater than the maximum outer diameter of the armature pin, the armature housing also including a second cylindrical portion coupled to the first cylindrical portion, the second cylindrical portion for slidably accommodating the armature, the second cylindrical portion having an inner minimum diameter greater than the maximum outer diameter of the armature;

a solenoid including a coil and a stator that engages the second cylindrical portion of the armature housing;

the armature pin having a distal end that is coupled to a closure element, the closure element engaging a first orifice of a orifice plate when the armature is in a relaxed position, the closure element being lifted off of the first orifice and orifice plate when the solenoid is energized and the armature, armature pin and closure element are moved away from the orifice plate;

an injector body that accommodates the armature housing, armature and armature pin, the injector body including a fuel passageway extends past the orifice plate to a valve chamber, the valve chamber accommodating a valve, the valve being in a closed position when the closure element engages the first orifice, the valve being in an open position when the closure element is moved away from the first orifice when the solenoid is energized, the orifice plate includes a second orifice for establishing an equilibrium pressure in the valve chamber when the valve chamber is closed.

* * * * *